US006749076B2

(12) United States Patent
Fingerhut et al.

(10) Patent No.: US 6,749,076 B2
(45) **Date of Patent: *Jun. 15, 2004**

(54) HIGH-STRENGTH LAMINATE PANEL CONTAINER

(75) Inventors: Solomon M. Fingerhut, Tarzana, CA (US); Richard L. Fingerhut, Tarzana, CA (US)

(73) Assignee: Telair International Incorporated, Rancho Dominquez, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/183,278

(22) Filed: Jun. 26, 2002

(65) Prior Publication Data

US 2002/0162837 A1 Nov. 7, 2002

Related U.S. Application Data

(63) Continuation of application No. 09/759,541, filed on Jan. 12, 2001, now Pat. No. 6,435,363, which is a continuation of application No. 09/160,409, filed on Sep. 25, 1998, now Pat. No. 6,237,793.

(51) Int. Cl.[7] ..... B65D 88/00

(52) U.S. Cl. ..... 220/1.5; 220/9.1; 109/15; 206/577

(58) Field of Search ..... 220/1.5, 9.1, 9.4, 220/900, 62.22, 62.19, 88.1; 206/577, 3; 190/125, 127

(56) References Cited

U.S. PATENT DOCUMENTS

| | | | | | |
|---|---|---|---|---|---|
| 3,567,536 | A | * | 3/1971 | Wickersham, Jr. | 156/78 |
| 3,739,731 | A | * | 6/1973 | Tabor | 109/49.5 |
| 4,212,406 | A | | 7/1980 | Mittelmann | 220/1.5 |
| 4,833,771 | A | | 5/1989 | Dunwoodie | 220/1.5 |
| 5,102,723 | A | | 4/1992 | Pepin | 428/223 |
| 5,180,078 | A | | 1/1993 | Looker | 220/665 |
| 5,195,701 | A | | 3/1993 | Willan | 244/118.1 |
| 5,242,070 | A | * | 9/1993 | Bretschneider et al. | 220/1.5 |
| 5,249,534 | A | | 10/1993 | Sacks | 109/24 |
| 5,267,665 | A | | 12/1993 | Sanai et al. | 220/88.1 |
| 5,312,182 | A | | 5/1994 | Mlakar et al. | 312/409 |
| 5,328,268 | A | | 7/1994 | LaFleur | 383/119 |

(List continued on next page.)

FOREIGN PATENT DOCUMENTS

| | | |
|---|---|---|
| WO | WO 93 22223 | 11/1993 |
| WO | WO 97 12195 | 4/1997 |

*Primary Examiner*—Mickey Yu
*Assistant Examiner*—Troy Arnold
(74) *Attorney, Agent, or Firm*—O'Melveny & Myers LLP

(57) ABSTRACT

The explosion resistant cargo container includes a frame including a main section and an angled projecting section, and is formed from a plurality of support members. The frame is covered with one or more explosion resistant sheets to form the explosion resistant side panels. The explosion resistant panels comprise a plurality of layers of explosion resistant sheets. The explosion resistant panels may also include a sheet of polycarbonate, and may also include padding or insulation placed between layers of the explosion resistant sheets. The side panels and flexible door comprise one or more of explosion resistant sheets, with one or more of the sheets of the plurality of explosion resistant sheets have edges wrapped around and secured to one or more mounting strips, with the edges of the plurality of explosion resistant sheets and mounting strips being bonded together. The mounting strips are currently preferably formed of metal, such as aluminum. Door frame members on either side of the door have door frame hooks to receive door hooks, so that when the door hooks are interfitted with the door frame hooks on either side of the flexible door, blast pressure from an explosion within the container will cause the connection of the door hooks and door frame hooks to tighten.

19 Claims, 13 Drawing Sheets

U.S. PATENT DOCUMENTS 5,360,129 A 11/1994 Lee ..... 220/1.5
5,390,580 A * 2/1995 Gibbons et al. ..... 86/50
5,395,682 A 3/1995 Holland et al. ..... 428/225
5,398,831 A * 3/1995 Avramides et al. ..... 220/1.5
RE34,892 E 4/1995 Dunwoodie ..... 220/1.5
5,413,410 A 5/1995 Mlakar ..... 312/409
5,421,804 A 6/1995 LeFleur ..... 493/210
5,425,456 A 6/1995 Erickson ..... 209/2
5,522,340 A 6/1996 Skogman ..... 114/357
5,542,765 A 8/1996 Smith et al. ..... 383/17
5,595,305 A 1/1997 Hart ..... 206/600
5,595,431 A 1/1997 Mlakar ..... 312/409
5,599,082 A * 2/1997 Mlakar et al. ..... 312/409
5,645,184 A 7/1997 Rowse et al. ..... 220/1.5
5,769,257 A 6/1998 Fleisher et al. ..... 220/1.5
5,890,612 A 4/1999 Coppi ..... 220/7
5,967,357 A 10/1999 Kellogg et al. ..... 220/9.2
6,019,237 A * 2/2000 Durham et al. ..... 220/1.6
6,161,714 A * 12/2000 Matsuura et al. ..... 220/1.5

* cited by examiner

FIG. 11
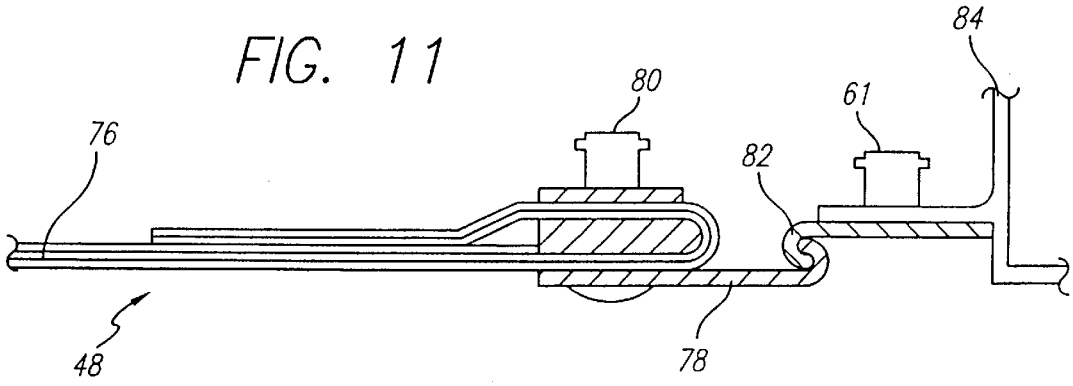
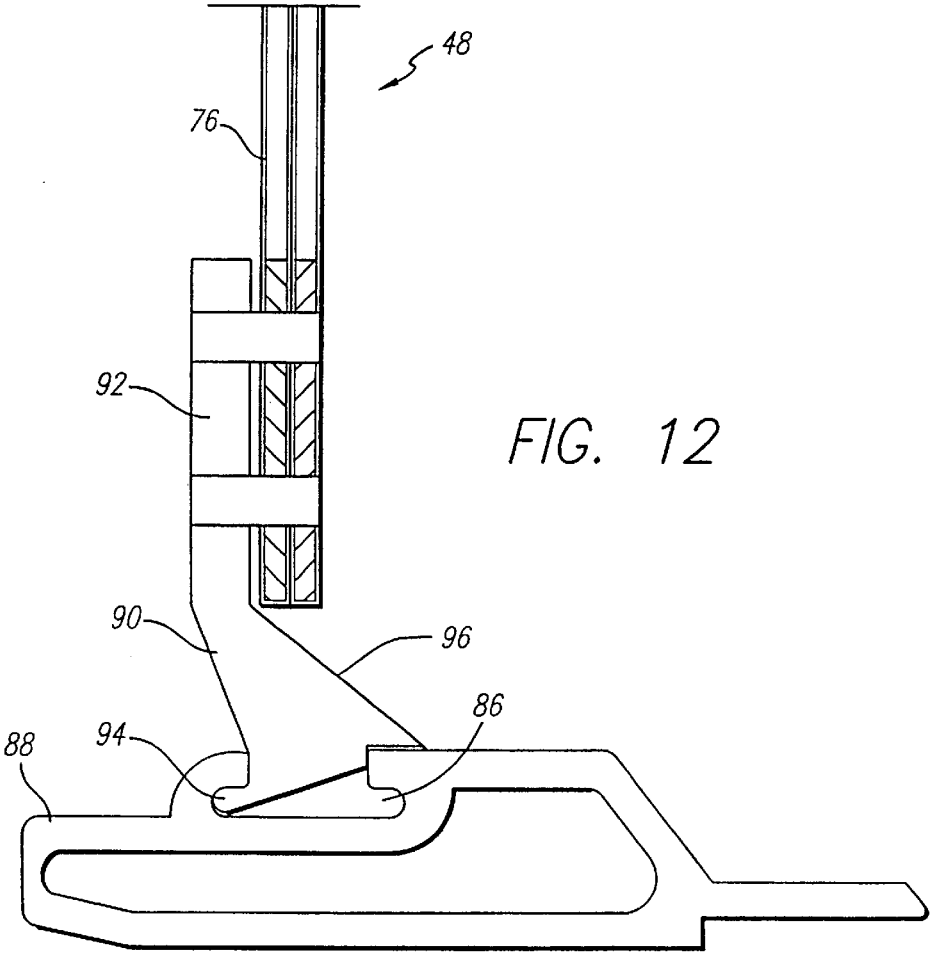
FIG. 12

HIGH-STRENGTH LAMINATE PANEL CONTAINER

RELATED APPLICATION

This application is a continuation of application Ser. No. 09/759,541, filed Jan. 12, 2001 now U.S. Pat. No. 6,435,363, which is a continuation of application Ser. No. 09/160,409, filed Sep. 25, 1998, now U.S. Pat. No. 6,237,793.

BACKGROUND OF THE INVENTION

1. Field of the Invention

This invention relates generally to cargo containers, and more particularly concerns a cargo container for aircraft or seagoing vessels that has flexible, explosion resistant side walls and a flexible, explosion resistant door that are capable of expanding to substantially contain an explosive blast within the container.

2. Description of Related Art

Conventional cargo containers for aircraft and seagoing vessels are typically not constructed to resist and contain explosive blasts, making such containers vulnerable to deliberate bombings and accidental explosions of materials being transported in such containers. Cargo containers for seagoing vessels can be made of a heavier, sturdier construction in order to withstand internal explosions, but it is typically not practical or economical to use such heavy cargo containers in aircraft, for which weight reduction is an important consideration.

In one approach to making cargo containers explosion resistant, the cargo container is hardened, being formed of flat Kevlar and resin panels joined together along their peripheries. The corners are reinforced by making them of a greater thickness, and the construction provides many layers to withstand an explosion.

Another approach to providing a explosion resistant cargo container provides a strong lightweight double-walled reinforced vessel having an intermediate single woven member formed from Kevlar, graphite or fiberglass, and disposed between spaced apart first and second walls. The intermediate woven member comprises a plurality of longitudinally extending cylindrical members positioned parallel to each other and a plurality of generally parallel fibers woven about the cylindrical members and extending perpendicularly to the cylindrical members. The woven layer is bonded between the first inner wall and the second outer wall with resinous materials.

Another collapsible storage container for the transportation and storage of goods which otherwise could not be stably stacked is formed of all Kevlar or other materials. The container is formed of four walls hingedly connected together, the walls being formed by frames made from welded sections of rectangular hollow section steel with infill panels of a mesh such as Kevlar. A roof member is formed from a frame and a mesh infill panel in the same manner as each of the walls, and L-shaped brackets on the walls captively engage a pallet underneath the container.

Another known aircraft cargo container that is capable of expanding to facilitate containment of an explosive blast is formed of panels fastened together at the corners to form a container capable of expanding to facilitate containment of an explosive blast. The top and side panels are formed of knitted aramid material, and are joined to each other at edges and corners. The knitted aramid fibers are sandwiched between layers of foam material sandwiched between an inner skin comprising a fiberglass layer bonded to a sheet of PVF, PVC, or polyurethane, and an outer aluminum skin. The inner skin is a two-layer material of open weave glass fiber impregnated with a resin and bonded to a thin sheet of polyvinyl fluoride or the like. To enable the edges of the panel to be connected to other panels or the door frames of the container and to provide a secure anchorage for the Kevlar sheets, the outer aluminum skin is formed around its edges with one flange being securely connected to another similar flange of the corner joint extrusion by uniformly spaced rivets or bolts which also penetrate through all the other layers of the panel.

Another known explosion resistant cargo container is formed from a structural sandwich panel made of many layers of Kevlar. The sandwich panel is made of rigid structural face sheets and a hybrid core of rigid rod members which pierce and cross through layers of soft, dry, energy-absorbing material. The soft energy-absorbing material of the core can be made of several dry layers of woven ballistic fabric from aramid fibers such as Kevlar. Graphite epoxy yarns are also sewn through the Kevlar fabric plies and the epoxy resin cured to rigidize the sewn cross-through members. The edges of the material were sewed and impregnated along the edges with epoxy resin for mounting in a frame.

It has however been found that while explosion resistant panels of various types can typically be made strong enough to contain an explosion, the seams along the frame where the panels are connected are typically the weakest point of the container in an explosion. There thus still exists a need a blast resistant cargo container with flexible, explosion resistant side walls for substantially containing the force of an explosion within the cargo container, that is relatively lightweight, with reinforcement of the seams along the frame where the panels are connected that are otherwise commonly the weakest point of the container during an explosion. The present invention meets these needs.

SUMMARY OF THE INVENTION

Briefly, and in general terms, the present invention provides for an improved, relatively lightweight explosion resistant cargo container having flexible, explosion resistant side walls for substantially containing the force of an explosion within the cargo container, the explosion resistant side walls having a unique edge assembly for reinforcing the seams of the explosion resistant side walls along the frame that are otherwise commonly the weakest point of the container during an explosion. In one preferred embodiment, the explosion resistant cargo container is made of a plurality of panels that are assembled with fasteners, and can be disassembled for shipping and repair. The panel construction allows for a simple repair, since a damaged panel can be replaced with a new panel by detaching the panel to be replaced, and attaching a replacement panel to the container. All of the panels are connected together so that a continuous explosion resistant container is formed on all sides of the container, including the door.

The invention accordingly provides for an explosion resistant cargo container suitable for aircraft or seagoing vessels for containing the effects of a bomb explosion within the cargo container, comprising a frame assembly, and a plurality of side walls including a bottom explosion resistant panel, a plurality of explosion resistant side walls, and an explosion resistant flexible door having two side edges and a bottom edge, the side panels and flexible door each being formed of one or more explosion resistant sheets of explosion resistant, flexible, high tensile strength material, the explosion resistant sheets having edges that are each wrapped around and secured to a mounting strip.

The frame preferably comprises a main section with two vertical front door post support members projecting from the bottom panel, a rear vertical side post support member projecting from the bottom panel, top transverse connector members connecting the vertical projecting support members, and flat gusset plates are provided for interconnecting at least some of the support members and transverse connector members of the support frame. The frame of the cargo container further typically comprises an angled projecting section, and the frame is comprised of a plurality of vertical support members and side transverse connector members.

In one presently preferred embodiment, each of the side walls are formed of individual explosion resistant side panels provided on the frame, along with a flexible door, with the edges of the explosion resistant sheets being connected by the unique edge assembly construction. While all of the panels are connected together so that a continuous explosion resistant container encompassing all sides and door of the container, this type of panel construction allows a damaged panel to be simply replaced with a new panel.

In another presently preferred embodiment, the frame is wrapped horizontally with one or more explosion resistant sheets to form a plurality of the explosion resistant side panels, and is wrapped vertically with one or more explosion resistant sheets to form a plurality of the explosion resistant side panels. One or more vertically wrapped explosion resistant sheets are currently preferably connected to one or more other explosion resistant sheets that extend along the bottom panel. The explosion resistant sheets are typically wider than the container, so that they are cut with notches at the corners, and overlap.

In a presently preferred aspect of the invention, the explosion resistant panels comprise a plurality of layers of explosion resistant sheets. The explosion resistant panels may also include a sheet of polycarbonate, and may also include padding or insulation placed between layers of the explosion resistant sheets. In another currently preferred aspect of the invention, the side panels and flexible door comprise a plurality of explosion resistant sheets, and at least one of the explosion resistant sheets of the plurality of explosion resistant sheets have edges wrapped around and secured to one or more mounting strips, with the edges of the plurality of explosion resistant sheets and the one or more one mounting strips being bonded together. The edges of the plurality of explosion resistant sheets and the one or more mounting strips are currently preferably bonded together by at least one layer of adhesive film, which can comprise a thermoplastic polymer, such as a semi-crystalline thermoplastic polymer, and is currently preferably a thermoplastic ionomer. Alternatively, the edges of the plurality of explosion resistant sheets and the one or more mounting strips can be bonded together by a coating of a bonding resin, such as epoxy resin.

In a currently preferred embodiment, each explosion resistant sheet comprises at least two layers of explosion resistant material, with at least two of the layers having edges around and secured to first and second mounting strips. In a presently preferred aspect, the edges of at least one layer of the explosion resistant sheets are bonded to the main body of the layers and to the metal strip by at least one layer of film adhesive. In another presently preferred aspect, one or more additional layers of explosion resistant material can be bonded by at least one layer of film adhesive to at least one layer of explosion resistant material bonded to a mounting strip.

In one presently preferred embodiment, the explosion resistant side panels comprise first and second explosion resistant sheets, an edge of the first explosion resistant sheet being wrapped around and secured to a first mounting strip, and an edge of the second explosion resistant sheet being wrapped around and secured to a second mounting strip, the edges of the first and second explosion resistant sheets and the first and second mounting strips being bonded together.

In an alternative preferred embodiment, the side panels comprise three explosion resistant sheets, an edge of the first explosion resistant sheet being wrapped around and secured to a first mounting strip, and an edge of the second explosion resistant sheet being wrapped around and secured to a second mounting strip, the edges of the first and second explosion resistant sheets and the first and second mounting strips being bonded together, with an edge of the third explosion resistant sheet being bonded between the first explosion resistant sheet and the second explosion resistant sheet.

In another alternative preferred embodiment, the side panels comprise four explosion resistant sheets, an edge of the first explosion resistant sheet being wrapped around and secured to a first mounting strip, and an edge of the second explosion resistant sheet being wrapped around and secured to a second mounting strip, the edges of the first and second explosion resistant sheets and the first and second mounting strips being bonded together, with edges of the third and fourth explosion resistant sheet being bonded between the first explosion resistant sheet and the second explosion resistant sheet.

In yet another presently preferred embodiment, the side panels comprise five explosion resistant sheets, an edge of the first explosion resistant sheet being wrapped around and secured to a first mounting strip, and an edge of the second explosion resistant sheet being wrapped around and secured to a second mounting strip, and the edges of the first and second explosion resistant sheets and the first and second mounting strips being bonded together with edges of the third, fourth and fifth explosion resistant sheet being bonded between the first explosion resistant sheet and the second explosion resistant sheet. The mounting strips are currently preferably formed of metal, such as aluminum.

The flexible door of the explosion resistant cargo container is also preferably formed of one or more explosion resistant sheets of explosion resistant, flexible, high tensile strength material, with the one or more explosion resistant sheets having edges that are each wrapped around and secured to a mounting strip, and door hooks mounted to the one or more explosion resistant sheets and the mounting strip along the side edges of the flexible door. In one presently preferred embodiment, the frame assembly comprises door frame members on either side of the door, with door frame hooks mounted to the door frame members corresponding to the door hooks, such that when the door hooks are interfitted with the door frame hooks on either side of the flexible door, blast pressure from an explosion within the container will cause the connection of the door hooks and door frame hooks to tighten. A strap is also preferably provided for securing the flexible door to the side walls of the cargo container when little or no tension operates to otherwise maintain the connection of the door hooks and door frame hooks.

The bottom explosion resistant panel typically preferably comprises an aluminum plate, and the explosion resistant sheets typically comprise a fabric formed from aramid fibers, although the explosion resistant sheets may also be formed from other explosion resistant, flexible, high tensile strength material such as a fabric formed from fiberglass.

These and other aspects and advantages of the invention will become apparent from the following detailed description and the accompanying drawings, which illustrate by way of example the features of the invention.

BRIEF DESCRIPTION OF THE DRAWINGS

FIG. 11 is a sectional view of the attachment of the flexible door by hooks to the frame of the explosion resistant cargo container of the invention; and FIG. 12 is a sectional view of the attachment of the bottom of the flexible door by hooks to the frame bottom panel of the explosion resistant cargo container of the invention.

DETAILED DESCRIPTION OF THE PREFERRED EMBODIMENTS

While various types of flexible and rigid explosion resistant cargo containers typically have panels of various types that can be made strong enough to contain an explosion, the seams along the frame where the panels are connected are commonly the weakest points of the container in an explosion.

Figure 1:
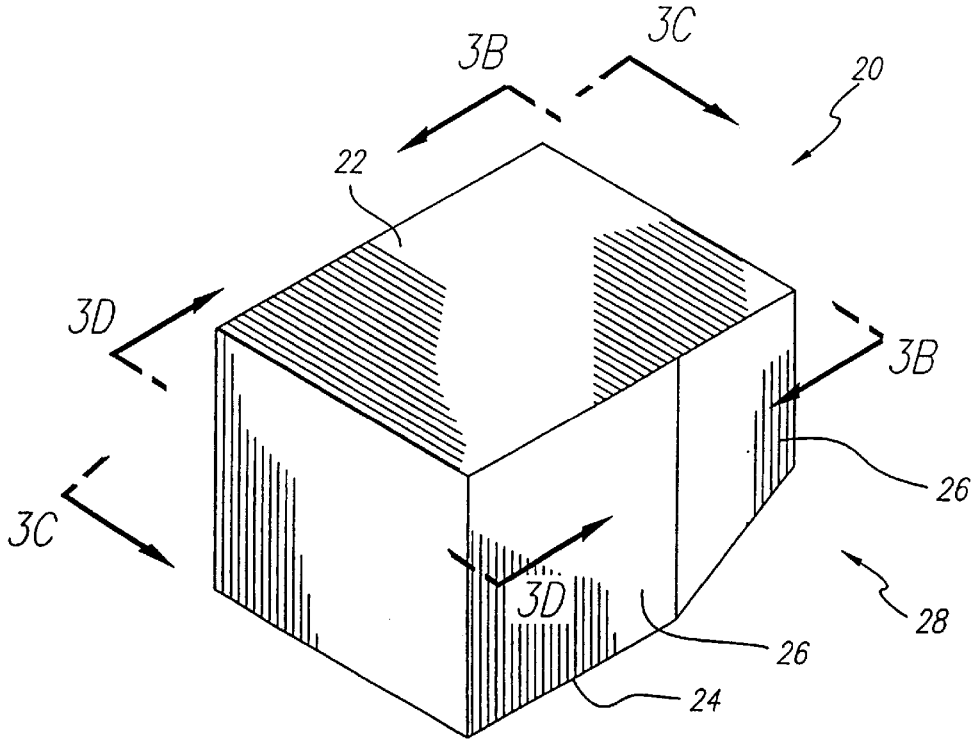
FIG. 1 is a rear perspective view of a first preferred embodiment of an explosion resistant aircraft cargo container according to the principles of the invention.
Figure 2:
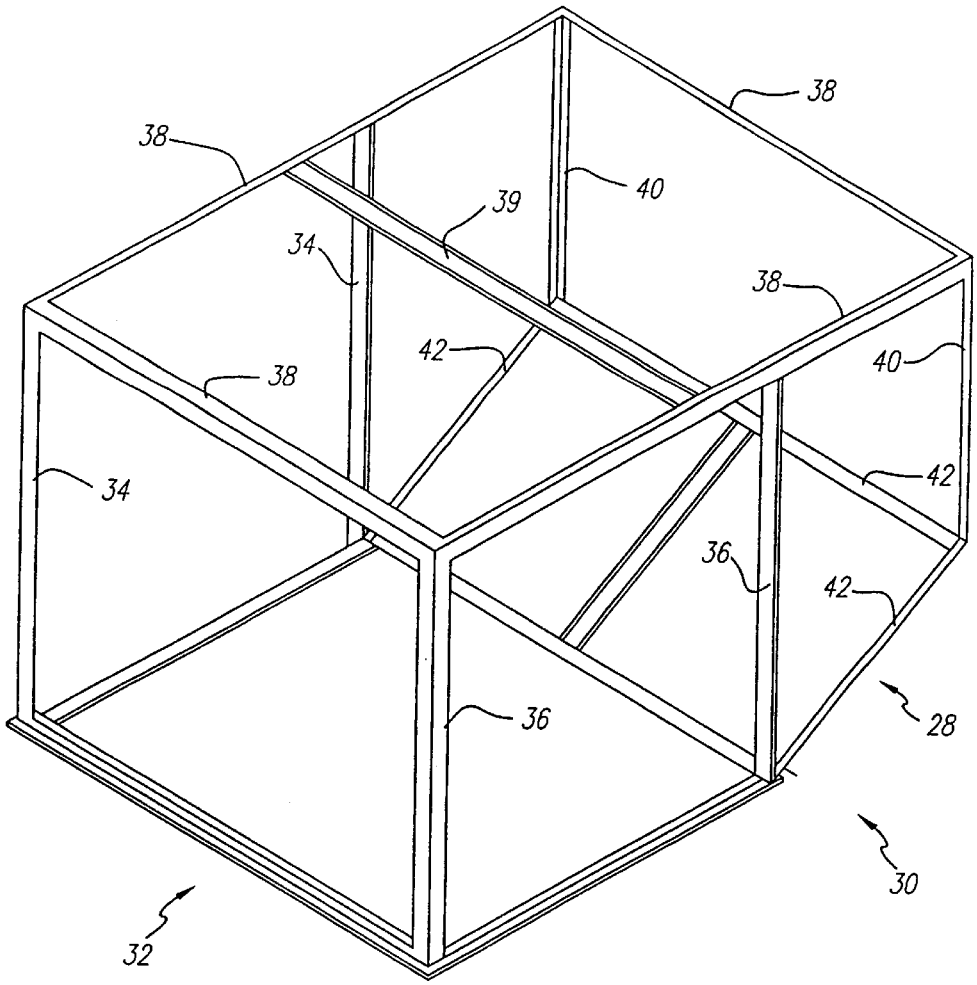
FIG. 2 is a schematic rear perspective view of a frame for the explosion resistant aircraft cargo container of FIG. 1.

As is illustrated in the drawings, the invention is accordingly embodied in an improved explosion resistant cargo container suitable for aircraft or seagoing vessels, with a standard frame construction as is illustrated in FIGS. 1, 2 and 3A to 3F. The container is explosion resistant in that is built to substantially contain the effects of a bomb explosion within the cargo container. The cargo container 20 generally comprises a top 22, a bottom explosion resistant panel 24, and a plurality of exterior explosion resistant side walls 26. The actual exterior shape of the container can be contoured to occupy a particular location, as for example, against the curved hull of a cargo aircraft or a seagoing vessel, by the addition of an angled projecting section 28. With reference to FIG. 2, the container includes a generally box shaped support frame assembly 30 including a main section 32 with two vertical front door post support members 34 projecting from the bottom panel, rear vertical side post support members 36 projecting from the bottom panel, top transverse connector members 38 connecting the vertical projecting support members, with a roof intermediate support member 39 connected between two opposing top transverse connector members, and the angled projecting section including vertical support members 40 and side transverse connector members 42, with an angled intermediate support member 43 connected between two opposing side transverse connector members 42. Referring to FIG. 3, showing the frame in greater detail, the cargo container also typically has flat gusset plates 44 interconnecting at least some of the support members and transverse connector members of the support frame.

As is illustrated in FIG. 3, in a first presently preferred embodiment, the side walls are formed of individual explosion resistant side panels 46 that are provided on the frame, along with a flexible door 48, with the edges of the explosion resistant sheets connected by the unique edge assembly construction illustrated in FIGS. 5A to 5F and 6A to 6F.

Figure 4:
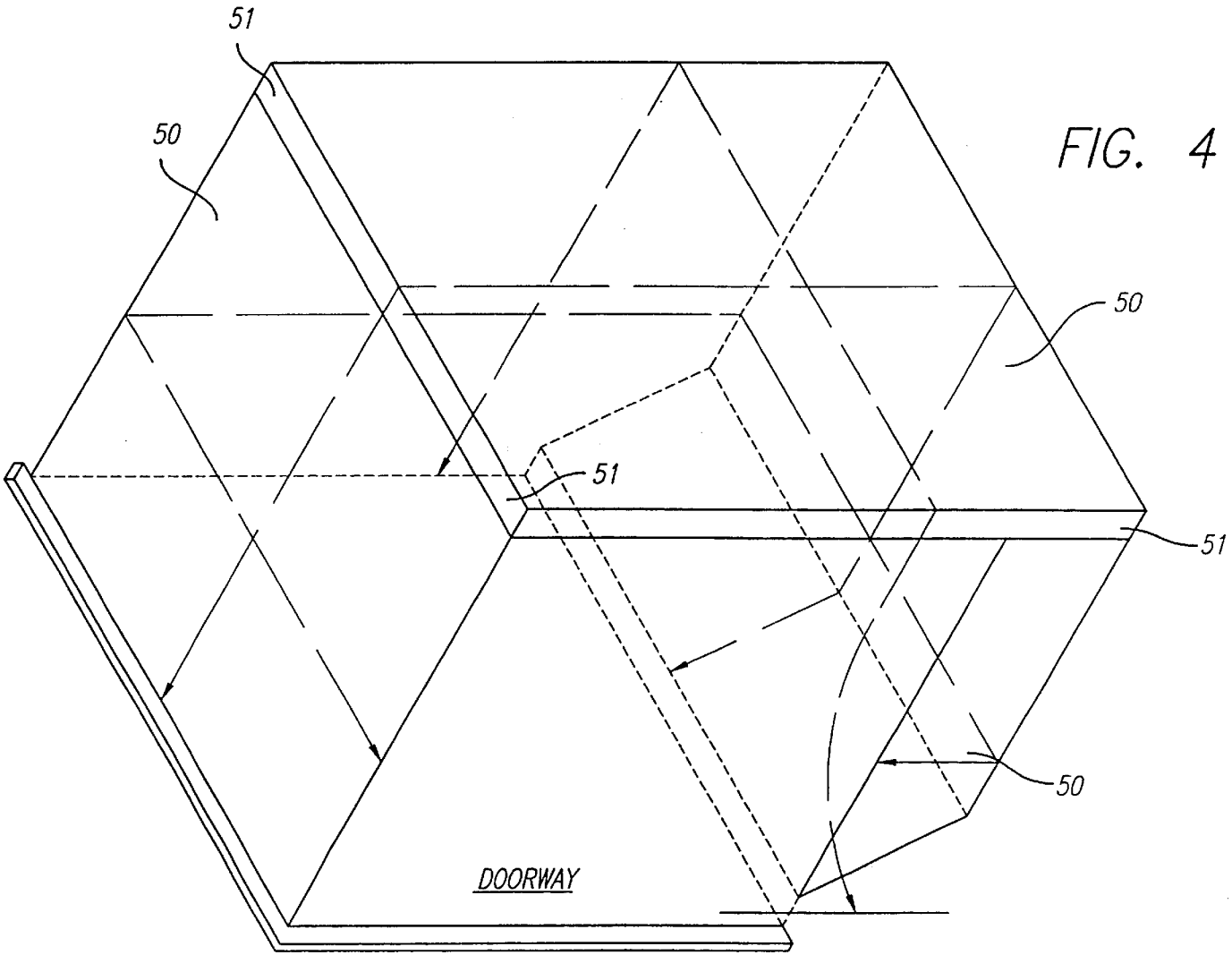
FIG. 4 is a schematic diagram illustrating the application of the plies of explosion resistant material to the frame in a second preferred embodiment of the explosion resistant aircraft cargo container of FIG. 1.

Referring to FIG. 4, in another presently preferred embodiment, the frame assembly can be wrapped horizontally and vertically with explosion resistant sheets 50 to form one or more of the explosion resistant panels, with the edges of the explosion resistant sheets connected by the unique edge assembly construction illustrated in FIGS. 5A to 5F and 6A to 6F. As is illustrated in FIG. 4, the explosion resistant sheets are preferably long enough to be wrapped horizontally or vertically to form two or more panels of the side walls, are typically wider than the container, being cut with notches 51 at the corners, and overlap.

In each of the presently preferred embodiments, the side panels and flexible door are formed of sheets of explosion resistant, flexible, high tensile strength material, such as fabric formed from aramid fibers, and currently preferably as fabric available from DuPont under the trade name "KEVLAR", although the explosion resistant sheets may also be formed from other explosion resistant, flexible, high tensile strength material such as a fabric formed from fiberglass. The explosion resistant sheets may also be made of an epoxy or other resin composite, a polyethylene material such as a woven or non-woven fabric available from Allied-Signal under the trade name "SPECTRA", and composites or combinations thereof. It has been found that while the explosion resistant panels are typically strong enough to contain an explosion, the seams along the frame where the panels are connected are typically the weakest point of the container in an explosion.

Figure 5A:
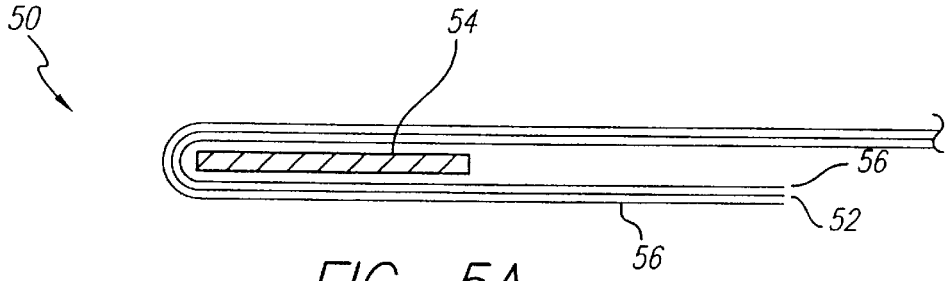
FIGS. 5A to 5F illustrate currently preferred configurations of the construction of the edge assembly of the explosion resistant sheets of the explosion resistant aircraft cargo container according to the principles of the invention.

In one presently preferred embodiment shown in FIG. 5A, an end or edge 52 of a explosion resistant sheet of material is wrapped around a mounting strip 54, with typically at least one layer of film adhesive 56 on each side of the explosion resistant sheet of material to bond the explosion resistant sheet of material and mounting strip together. The mounting strip is typically about one inch wide, and is preferably metal, such as aluminum, although stainless steel or other materials such as a strong, rigid polymer or composite may also be suitable for use as a mounting strip. The overlapping end of the sheet of explosion resistant material typically extends beyond the mounting strip and overlaps the main portion of the sheet of explosion resistant material by approximately 1.5 to 3.5 inches. The film adhesive is preferably a thermoplastic polymer, such as an amorphous "hot melt" type of thermoplastic such as polyethylene, a thermoplastic ionomer, or a semi-crystalline thermoplastic, melting at a temperature of about 275 F., although thermoplastics melting at about 150 F. to about 1000 F. may also be suitable. The sheet of explosion resistant material is typically wrapped about the mounting strip and then heated under vacuum to seal and secure the explosion resistant sheet of material around the mounting strip. Alternatively, the sheets of explosion resistant material can be bonded to the mounting strips by a thermosetting plastic, such as polyurethane, or a thermosetting resin, such as epoxy resin, for example, although other similar resins may also be suitable.

Figure 5B:
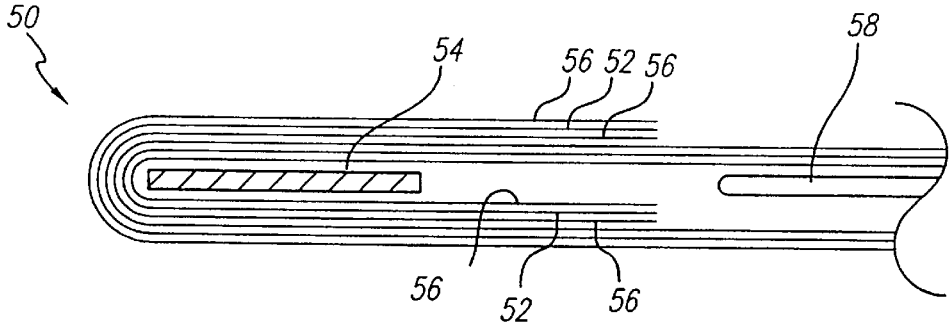
Figure 5C:
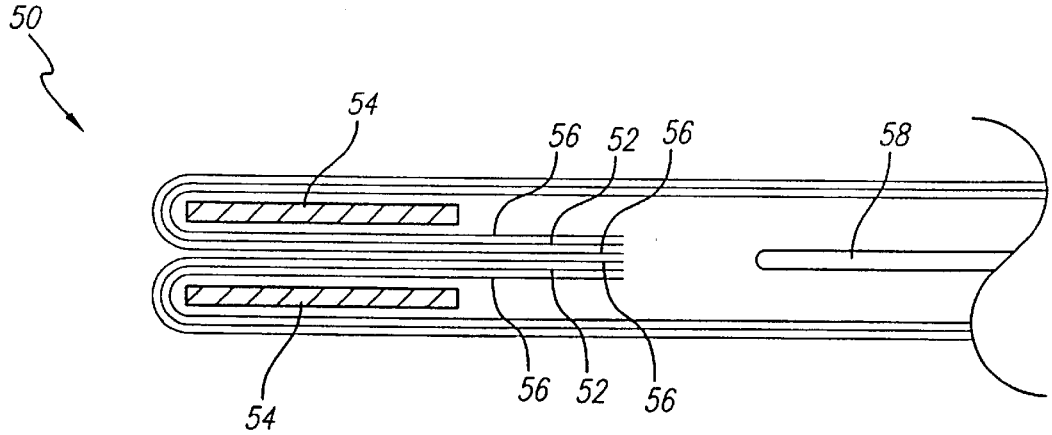
Figure 5D:
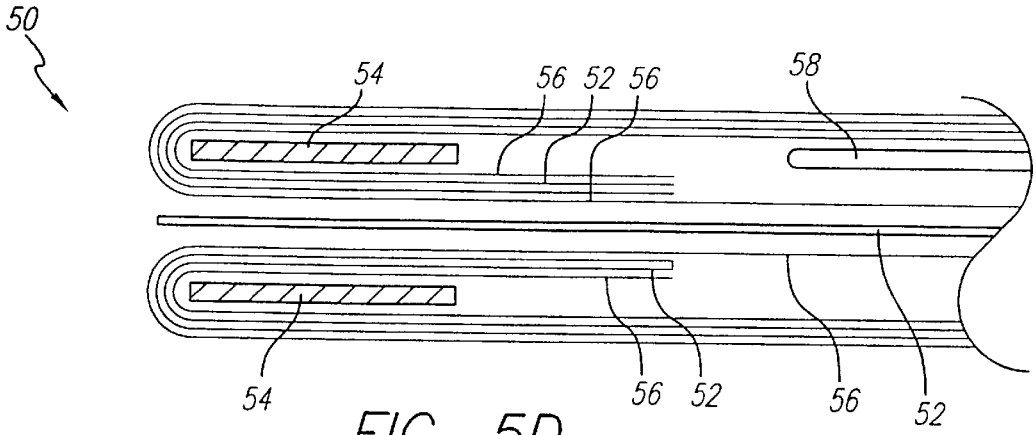
Figure 5E:
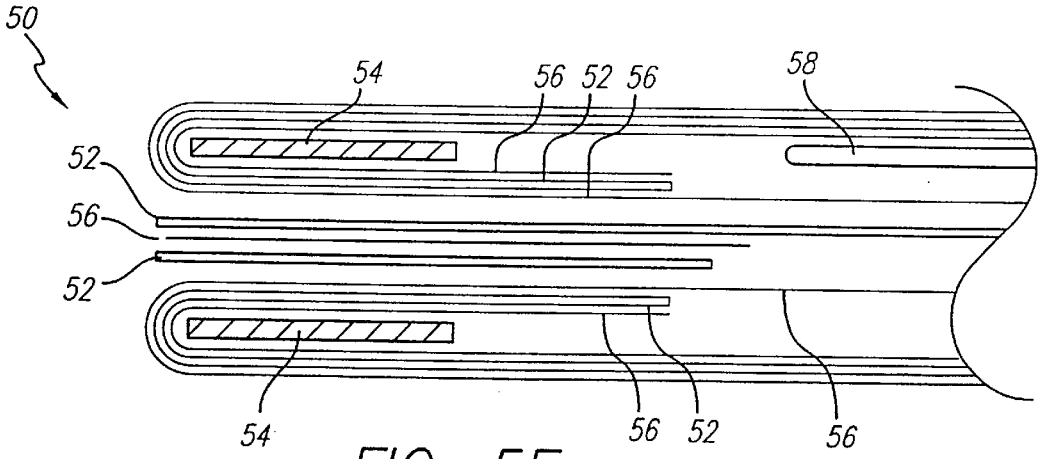
Figure 5F:
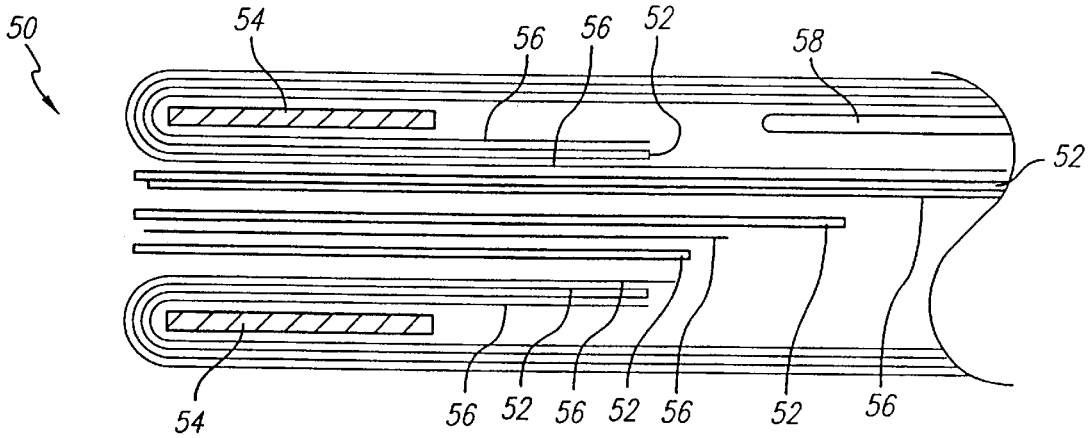
Figure 6A:
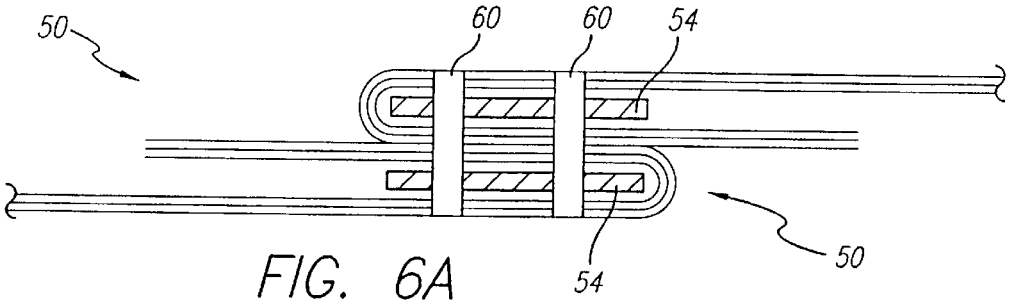
FIGS. 6A to 6F illustrate currently preferred configurations of the connection of the edges of the explosion resistant sheets of the explosion resistant aircraft cargo container of the invention.
Figure 6B:
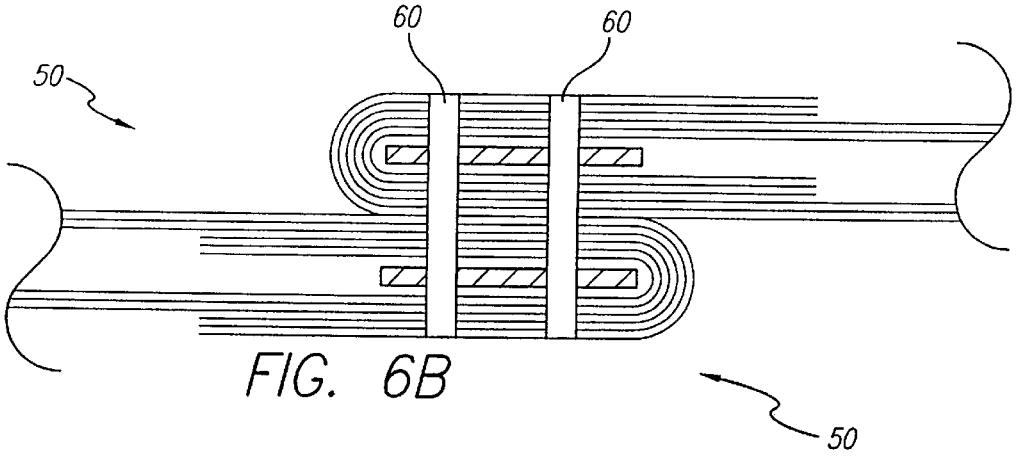
Figure 6C:
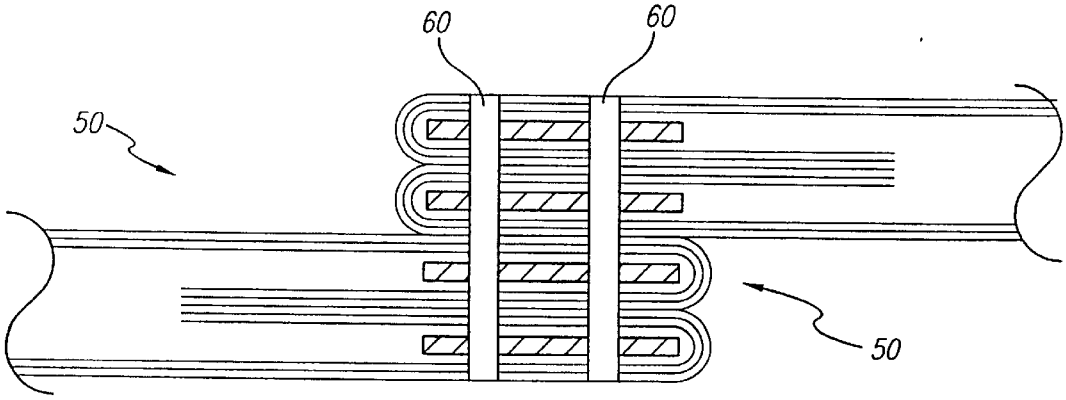
Figure 6D:
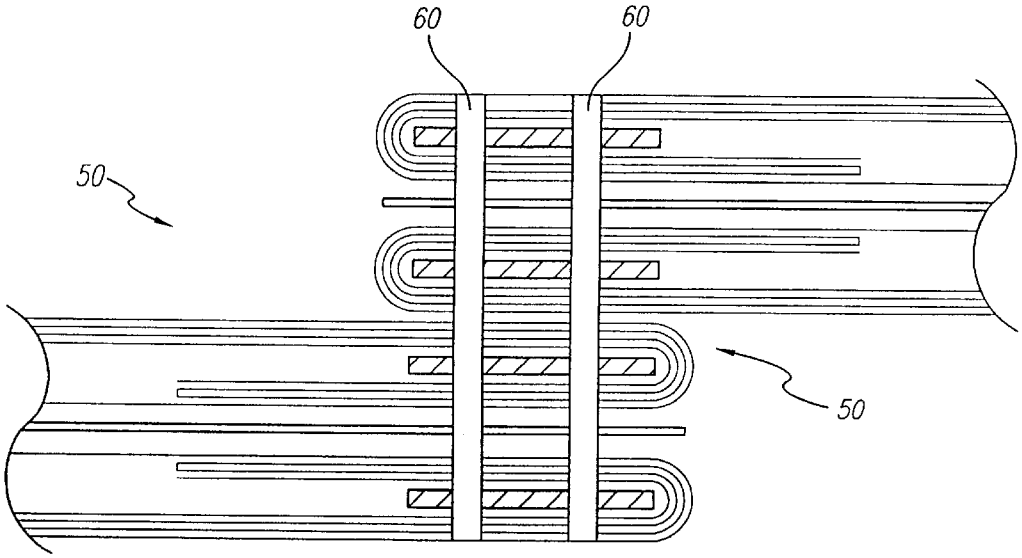
Figure 6E:
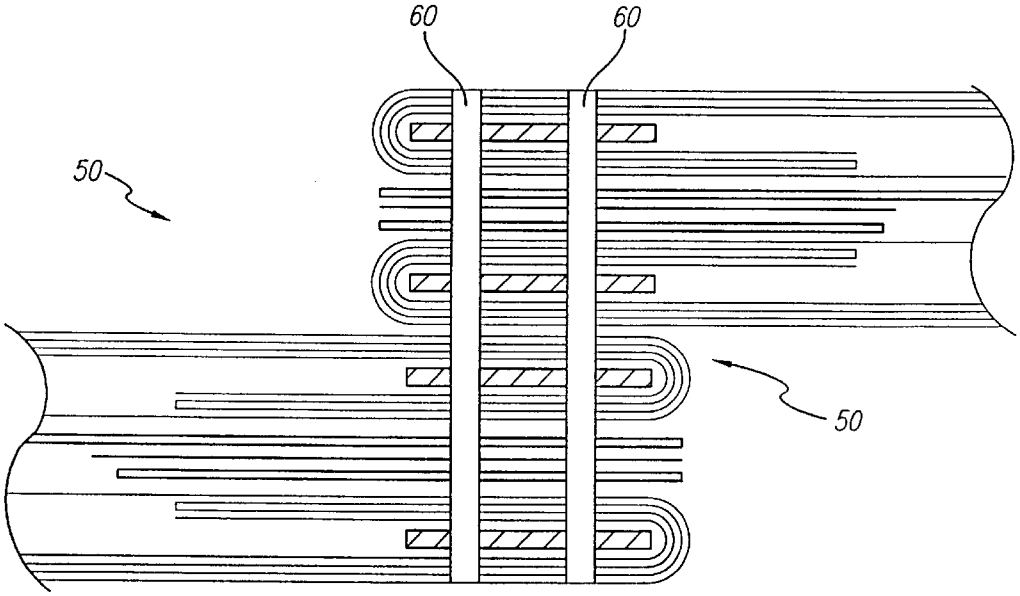
Figure 6F:
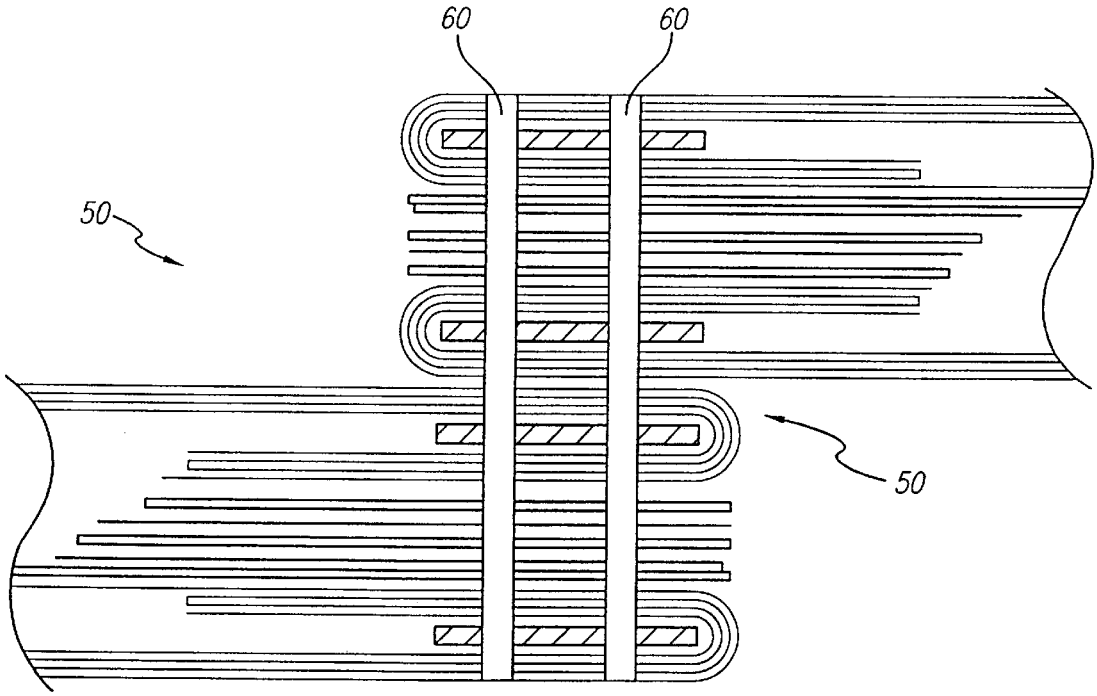

As is illustrated in FIG. 5B, in another presently preferred embodiment, the edges 52 of two sheets of explosion resistant material with layers of film adhesive 56 on either side of the explosion resistant sheet of material may also be wrapped around one mounting strip 54 and assembled as noted above. Referring to FIG. 5C, another preferred configuration for assembling a multi-layer sheet of explosion resistant material involves assembling wrapping the edges 52 of first and second individual sheets of explosion resistant material, with layers of film adhesive 56 typically on either side of each of the explosion resistant sheets of material, around first and second mounting strips, respectively, with the overlapping ends of the explosion resistant sheets of material disposed between the two mounting strips, and assembled as noted above. As is shown in FIGS. 5D to 5F, additional individual sheets of the explosion resistant sheets of material can be inserted between the overlapped inner ends of the outer layers of explosion resistant sheets of material. When a full length sheet of explosion resistant material is inserted between he outer layers of explosion resistant sheets of material, as shown in FIG. 5D, at least one layer of adhesive material is typically extended along the length of the inserted sheet of material. As is shown in FIGS. 5E and 5F, shorter lengths of explosion resistant material may also be inserted between the mounting strips, to additionally reinforce the bonding about the joint formed about the mounting strip, and when multiple additional sheets are inserted, the lengths of the overlapping ends are preferably staggered, as can be best seen in FIG. 5F, to more evenly distribute the strain experienced at the juncture of the end of the explosion resistant sheet of material where it is bonded to the main body of the explosion resistant sheet of material. The multilayer forms of the explosion resistant sheets may also include additional layers of material 58, such as insulation, padding, and one or more sheets of polycarbonate, placed between the layers of the multi-layer explosion resistant sheets.

Figure 7:
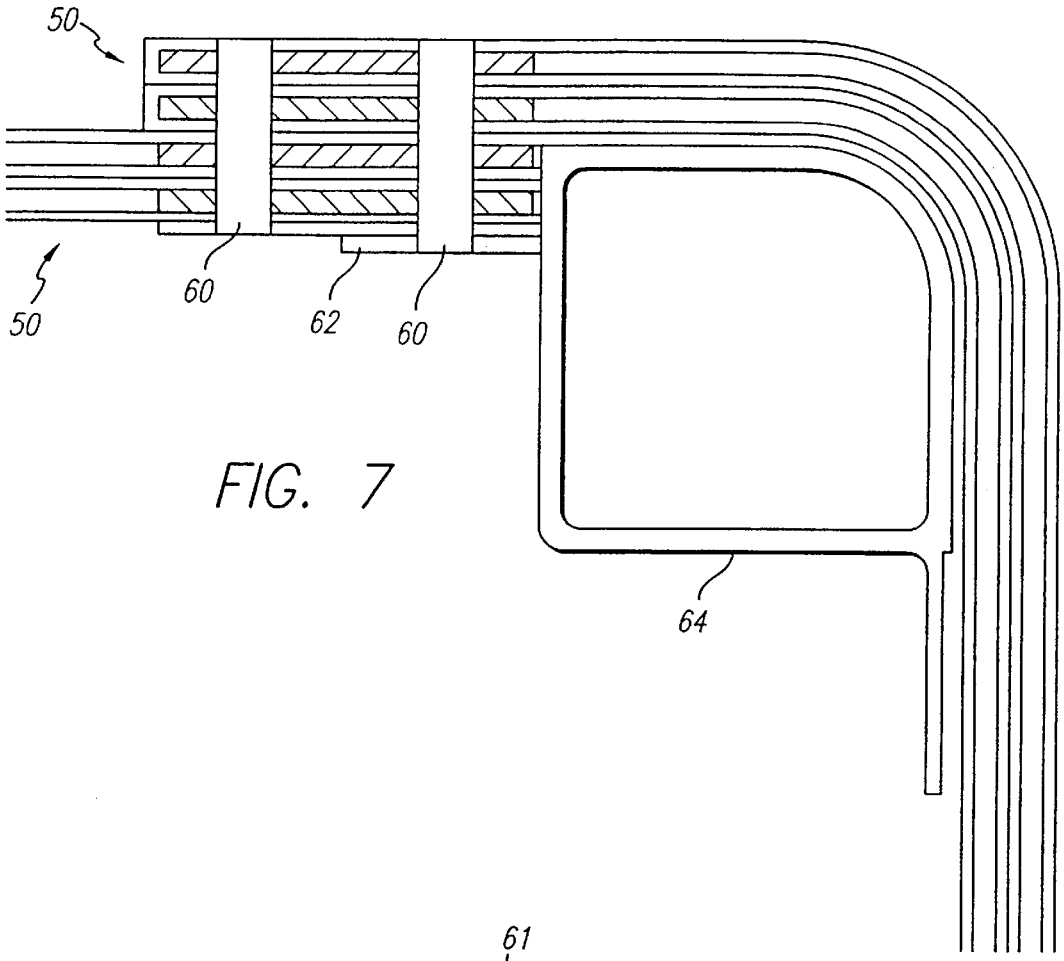
FIG. 7 is an illustration of a preferred connection of a pair of edge assemblies connecting explosion resistant sheets to a support member of the frame of the explosion resistant aircraft cargo container of the invention.
Figure 8:
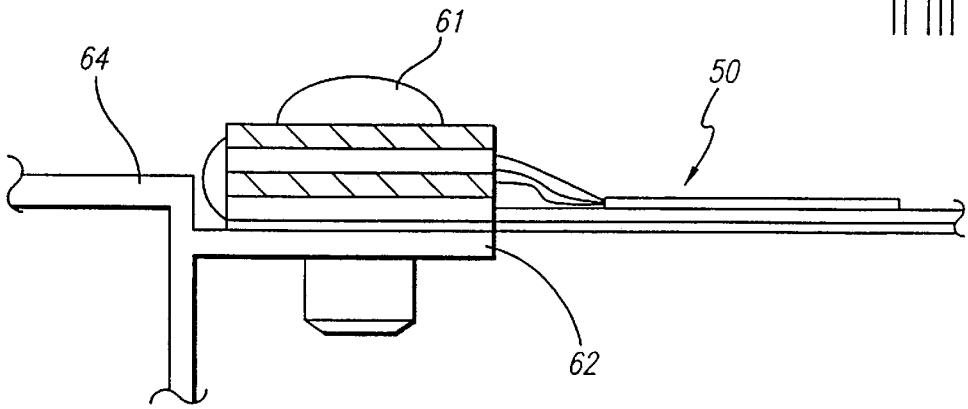
FIG. 8 is an illustration of an alternative preferred connection of an edge assembly of an explosion resistant sheet to a support member of the frame of the explosion resistant aircraft cargo container of the invention.

In joining the ends of adjacent sheets of explosion resistant material together, as is illustrated in FIGS. 6A to 6F and FIG. 7, bolt holes 60 are punched or drilled in adjacent, overlapping ends of explosion resistant sheets, and are preferably bolted together by bolts placed through the bolt holes formed in the mounting strips. As shown in FIGS. 7 and 8, the bolt holes 60 and bolts 61 through the edge assembly of the ends of adjacent explosion resistant sheets of material can also extend through a flange 62 of support members 64 of the frame, to further secure the explosion resistant sheets of material to the frame of the cargo container. While bolts are described here for fastening the explosion resistant sheets and mounting strips to the frame, it will be readily understood that other types of fasteners such as screws or rivets, for example, may also be suitable.

Figure 9:
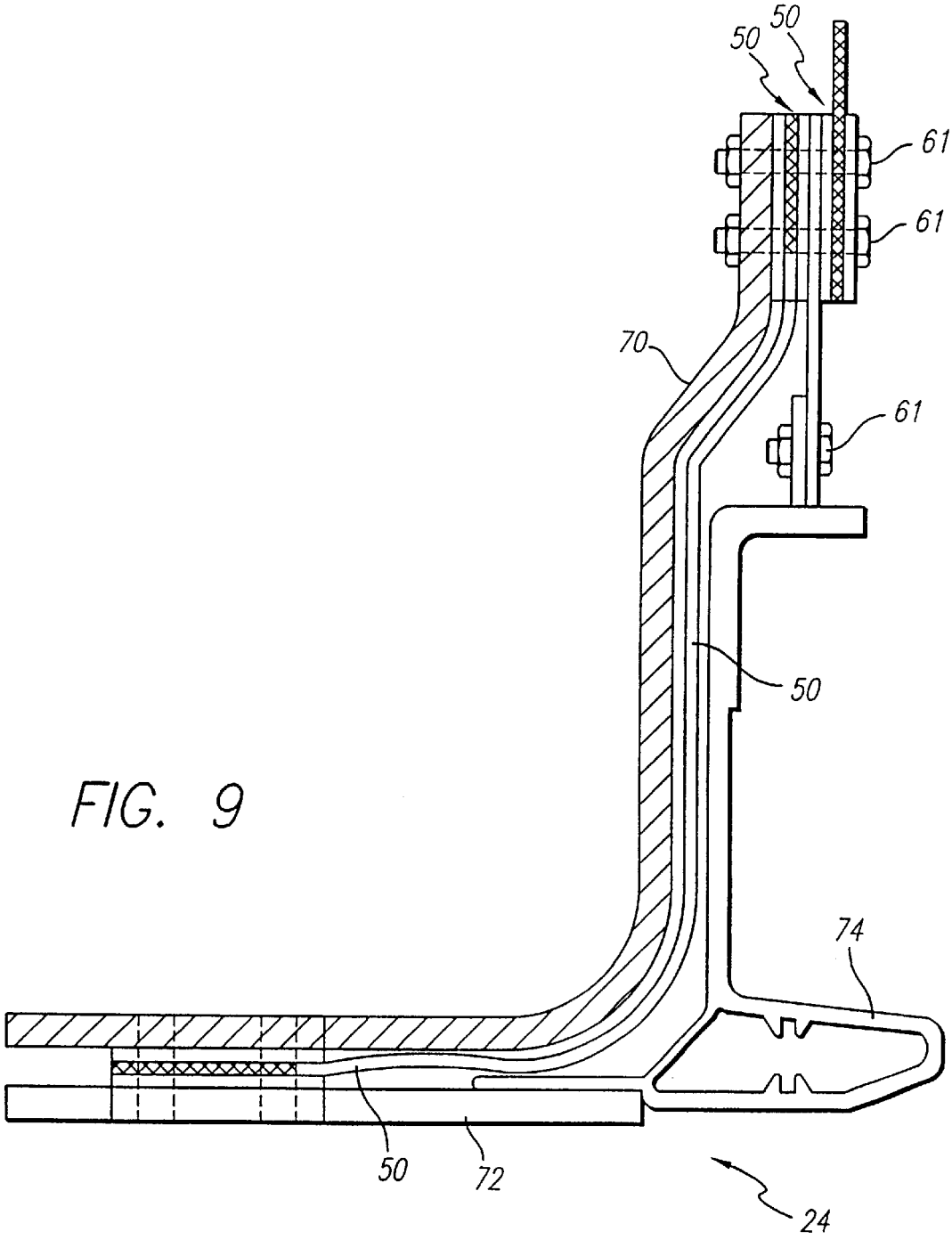
FIG. 9 is a sectional view of a connection of an explosion resistant sheet to a bottom panel of the frame of the explosion resistant aircraft cargo container of the invention.
Figure 10:
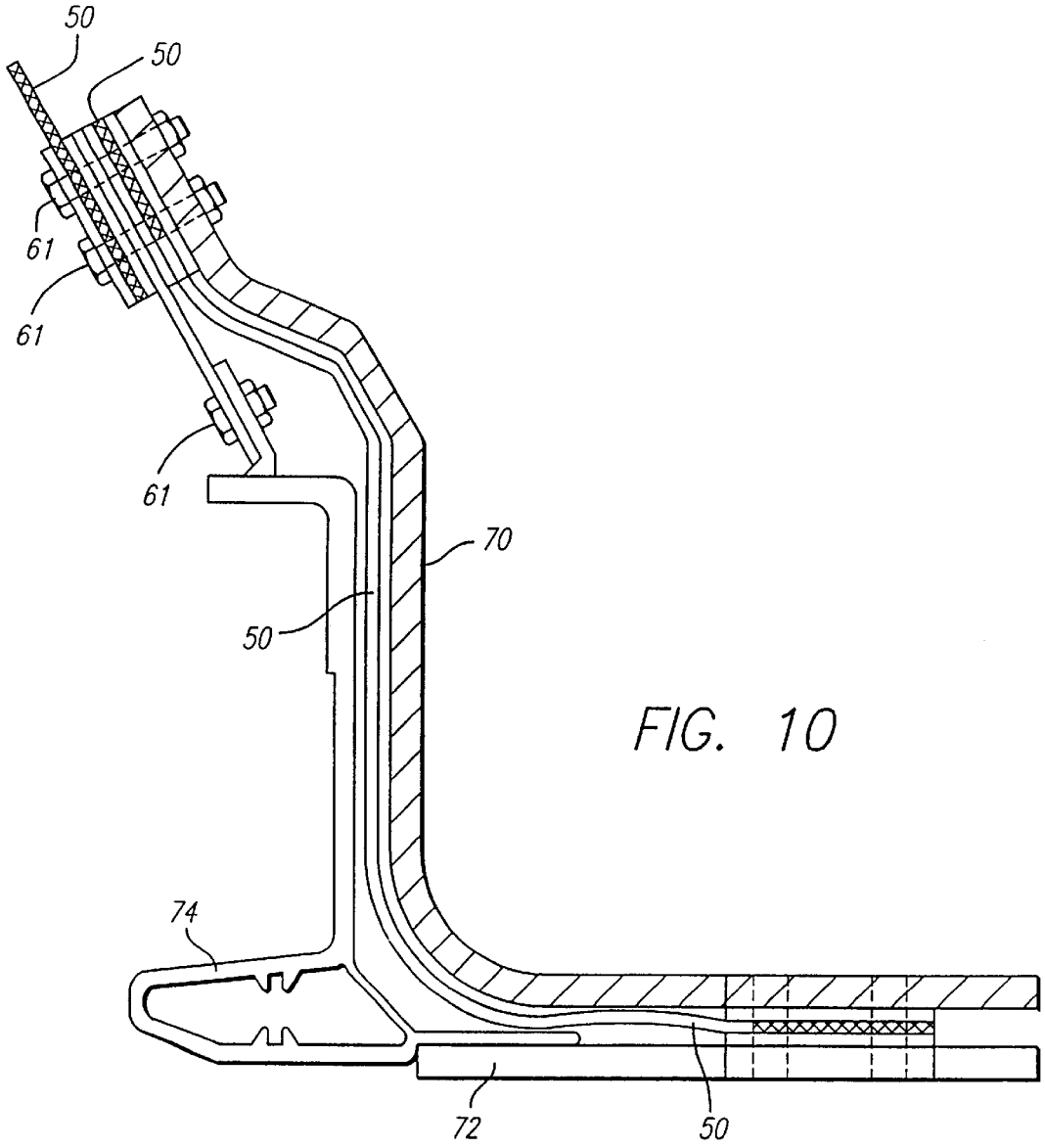
FIG. 10 is a sectional view of a connection of an explosion resistant sheet to a bottom panel of the frame at the projecting portion of the explosion resistant cargo container of the invention.

Referring to FIGS. 9 and 10, the bottom explosion resistant panel of the container is currently preferably a molded pan 70 formed of fiberglass and a bottom metal plate 72, typically aluminum, with an explosion resistant sheet secured by the edge assembly construction described above and passing between the molded pan and the bottom metal plate. A bottom perimeter molding 74 also preferably connects the bottom metal plate to the molded pan and edge assembly of the explosion resistant sheets of material, such as by bolts 61. The molded pan can also be formed of a molded aluminum plate, for example, and the bottom metal plate can also be formed of other materials, such as stainless steel, for example. The vertically wrapped explosion resistant sheet is connected by the edge assemblies to extend to the inside of the container, above the bottom explosion resistant plate, where the ends of the explosion resistant sheet are bolted by the edge assembly as described above to the molded pan of the bottom panel.

Figure 3A:
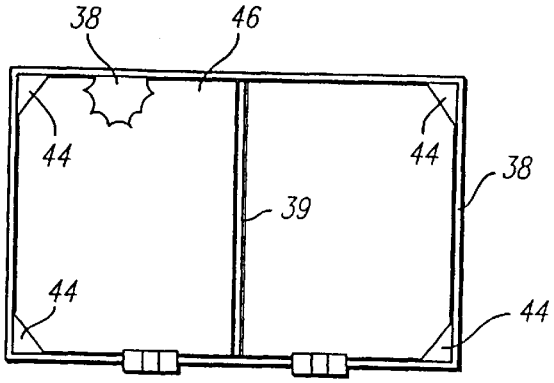
FIG. 3A is a top schematic view of the aircraft cargo container of FIG. 1.
Figure 3B:
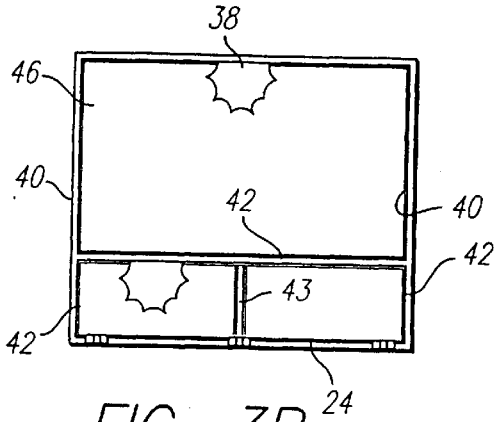
FIG. 3B is a side elevational schematic view of the aircraft cargo container taken along line 3B—3B of FIG. 1.
Figure 3C:
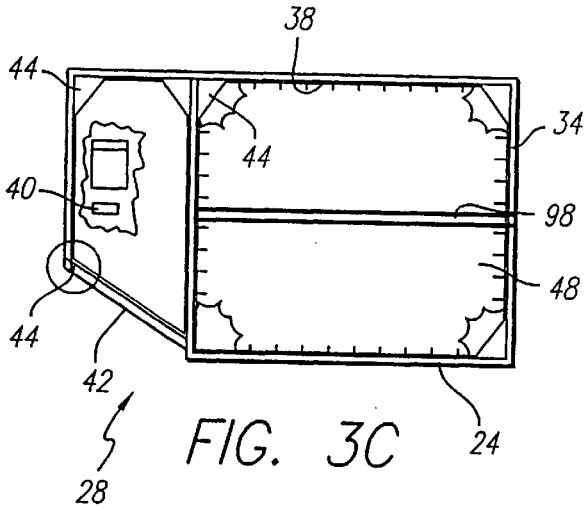
FIG. 3C is a front schematic view of the aircraft cargo container taken along line 3C—3C of FIG. 1.
Figure 3D:
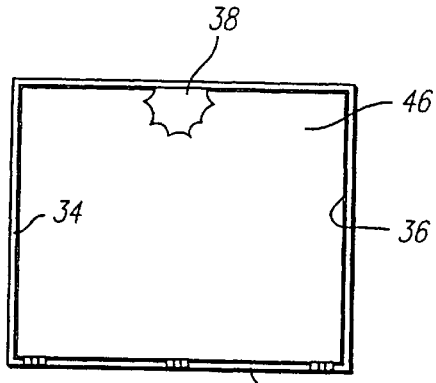
FIG. 3D is a side elevational schematic view of the aircraft cargo container taken along line 3D—3D of FIG. 1.
Figure 3E:
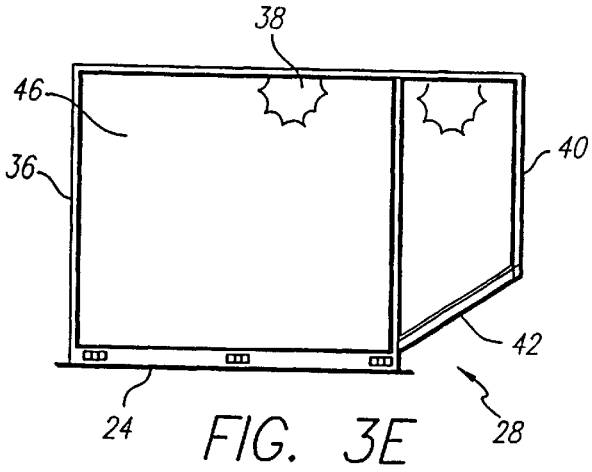
FIG. 3E is a rear schematic view of the aircraft cargo container of FIG. 1.
Figure 3F:
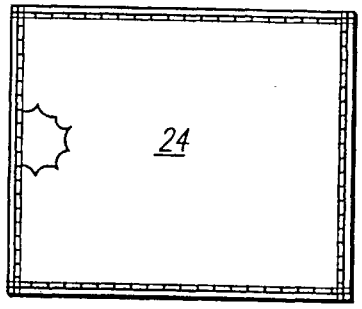
FIG. 3F is a bottom schematic view of the aircraft cargo container of FIG. 1.

As is illustrated in FIGS. 11 and 12, the flexible door similarly is formed of one or more sheets 76 of explosion resistant material, as described above, and may also include a polycarbonate sheet placed between layers of the explosion resistant material, as noted above. The edges of the explosion resistant material of the door are also secured together with the edge assembly construction as described above, and also include door hooks 78 that are secured to the edge assembly by bolts 80, as well as by bonding, such as by film adhesive as described above, or alternatively by epoxy resin, for example. The door hooks advantageously interfit with corresponding door frame hooks 82 bolted to the support members forming the door frame 84, on either side of the door. Alternatively the door hooks can be secured to grooves formed in the support members forming the door frame, on either side of the door. Such a groove 86 is shown formed in the front bottom panel perimeter molding 88 for receiving bottom door hooks 90 secured to the flexible door. The bottom door hooks preferably have a shaft 92, a hook portion 94, and a flange 96 facing outwardly when the door is closed and bracing the bottom door hook against the front bottom panel perimeter molding against the pressure against the door of an explosion within the cargo container, to help contain the force of the blast. When the door hooks are in place on either side of the door, blast pressure from within the container also will tighten the connection of the door hooks to the frame; otherwise, when the door is closed and not under tension, it may be easily unlatched from the door frame. As is illustrated in FIG. 3C, in normal use, the door is typically additionally strapped in a closed position by one or more straps 98.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. A high-strength panel container, comprising:

a frame assembly;

a plurality of panels and a door mounted to the frame assembly for enclosing an interior of the container, the panels each comprising at least one sheet of flexible, high tensile strength material, the at least one sheet having an edge that is wrapped around, secured to, and substantially enclosing a mounting strip; and a plurality of fasteners extending through the mounting strip, securing adjacent panels together.

2. The container of claim 1, wherein each of the plurality of panels further comprises a plurality of sheets of flexible, high-strength material in a layered configuration.

3. The container of claim 2, wherein at least ones of the plurality of sheets comprise a flexible fabric.

4. The container of claim 2, wherein at least ones of the plurality of sheets comprise a polycarbonate material.

5. The container of claim 2, wherein each of the plurality of panels comprises padding material interposed between ones of the sheets.

6. The container of claim 2, wherein each of the plurality of panels comprises insulation material interposed between ones of the sheets.

7. The container of claim 2, wherein at least ones of the plurality of sheets comprise aramid fibers.

8. The container of claim 2, wherein at least ones of the plurality of sheets comprise fiberglass.

9. The container of claim 2, wherein each of the plurality of panels further comprises a resin bonding adjacent ones of the plurality of sheets together.

10. The container of claim 9, wherein the resin comprises a thermoplastic polymer.

11. The container of claim 9, wherein the resin comprises a semi-crystalline thermoplastic polymer.

12. The container of claim 9, wherein the resin comprises an ionomer.

13. The container of claim 9, wherein the resin comprises epoxy resin.

14. The container of claim 1, wherein the mounting strip comprises a metal.

15. The container of claim 1, wherein the mounting strip comprises aluminum.

16. The container of claim 1, wherein the door comprises at least one sheet of flexible, high-strength material, the at least one sheet having an edge that is wrapped around and secured to the mounting strip, and door connection elements mounted to the at least one sheet and the mounting strip along an edge of the door.

17. The container of claim 16, wherein the frame assembly comprises door frame members on either side of the door, with door frame connection elements mounted to the door frame members and connected to the door connection elements, whereby blast pressure from an explosion within the container will cause connection of the door connection elements and door frame connection elements to tighten.

18. The container of claim 1, wherein the plurality of fasteners are selected from the group consisting of bolts, screws, and rivets.

19. The container of claim 1, wherein the door comprises at least one sheet of flexible, high-strength material, the at least one sheet having an edge that is wrapped around and secured to a second mounting strip, and door connection elements mounted to the at least one sheet and the second mounting strip along an edge of the door.

* * * * *